US007458700B2

(12) United States Patent
Gordin

(10) Patent No.: US 7,458,700 B2
(45) Date of Patent: Dec. 2, 2008

(54) ELECTIVE LIGHTING FIXTURE VISORS TO IMPROVE PLAYABILITY FOR AERIAL SPORTS

(75) Inventor: Myron K. Gordin, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 154 days.

(21) Appl. No.: 11/364,971

(22) Filed: Mar. 1, 2006

(65) Prior Publication Data

US 2006/0198145 A1 Sep. 7, 2006

Related U.S. Application Data

(60) Provisional application No. 60/657,299, filed on Mar. 1, 2005.

(51) Int. Cl.
*F21S 8/00* (2006.01)
*F21S 6/00* (2006.01)
*F21V 33/00* (2006.01)

(52) U.S. Cl. ..... 362/235; 362/431

(58) Field of Classification Search ..... 362/153.1, 362/247, 263, 348, 431, 235
See application file for complete search history.

(56) References Cited

U.S. PATENT DOCUMENTS 3,156,418 A * 11/1964 Jablonski et al. ..... 52/28
4,459,649 A * 7/1984 Shaneour ..... 362/396
4,816,974 A 3/1989 Gordin
5,274,534 A * 12/1993 Armstrong ..... 362/249
5,426,577 A * 6/1995 Gordin et al. ..... 362/431
6,036,338 A 3/2000 Gordin
2006/0176704 A1 8/2006 Gordin et al.
2006/0181875 A1 8/2006 Gordin et al.
2006/0181882 A1 8/2006 Gordin et al.
2006/0187663 A1 8/2006 Gordin et al.

* cited by examiner

*Primary Examiner*—Sandra O'Shea
*Assistant Examiner*—James W Cranson
(74) *Attorney, Agent, or Firm*—McKee, Voorhees & Sease, P.L.C.

(57) ABSTRACT

A method, apparatus and system for illuminating a sports field. The method includes identifying fixtures having a likelihood of affecting playability or glare or spill light relative to a point of view on or off the field. The method includes steps to identify such fixtures for the purpose of adding a component which improves playability or decreases glare or spill light for the point of view. A further method does so for multiple points of view relative to the field, whether on or off the field. One component is a long visor that would be added only to identified fixtures.

51 Claims, 9 Drawing Sheets

ELECTIVE LIGHTING FIXTURE VISORS TO IMPROVE PLAYABILITY FOR AERIAL SPORTS

I. CROSS-REFERENCE TO RELATED APPLICATIONS

This application claims priority under 35 U.S.C. § 119 of a provisional application Ser. No. 60/657,299 filed Mar. 1, 2005, which application is hereby incorporated by reference in its entirety.

II. BACKGROUND OF THE INVENTION

A. Field of Invention

The present invention relates to wide area lighting systems which utilize a plurality of light fixtures elevated at substantial heights relative to an area or volume of space to be lighted. In particular, the present invention relates to addition of visors of specific characteristics to just selected fixtures to address playability and glare or spill light issues.

B. Issues in the Present State of the Art

A conventional and well-known way to light large areas economically is to erect several poles at spaced positions around the area to be lighted. Each pole would elevate one or more bowl-shaped reflectors, each surrounding a high intensity discharge (HID) lamp. Each fixture produces a relatively controlled and concentrated beam of light. By appropriate design and aiming of the fixtures, the beams can be directed from various directions to compositely light the target area relatively uniformly.

A primary example of such lighting is for outdoor sports fields. The owner of the present application, Musco Corporation, has been involved in such sports field lighting for many years. Their website, www.musco.com, provides information and background on such lighting.

These types of lighting systems have been successful because they are both effective and relatively economical. By efficient engineering design, the number of fixtures to effectively light the area can be minimized. Thus, cost of the system (including minimization of number of poles—which can be sometimes be the largest portion of cost of such systems) can be minimized.

However, to achieve the type of light levels for sports such as baseball, football, softball, soccer, etc., relatively powerful light sources are required. Thus, issues of glare and spill light exist with these systems. For example, a player on the field can be affected by glare caused by looking directly at one of these powerful HID light sources in a fixture. Glare, as well as spill light, relative to a homeowner across the street from the sports field can also be an issue. The issues of glare and spill light are well-known in the art. A variety of attempts have been made to address glare and spill. The owner of the present application has developed a number of systems for the same. Examples can be found at the U.S. Patent and Trademark Office under the assignee name of Musco Corporation. One specific example is U.S. Pat. No. 4,816,974 (incorporated by reference hereto). U.S. Pat. No. 4,816,974 gives some discussion of glare and spill issues and considerations, as well as general information about sports lighting and the type of fixtures commonly used. While these glare and spill light control methods have generally worked well, there usually is some balancing of factors involved in glare and spill control. For example, complete elimination of spill light to areas surrounding the field may require substantial and drastic glare and spill control measures, which could be expensive, diminish the light available to use at the field, and involve the need for additional fixtures which would increase cost. Sometimes, glare and spill is not an issue for the field, but many times it is. Sometimes effective design of the lighting system (e.g. placement of poles, number and direction of aiming of fixtures, etc.) can avoid the need for drastic glare and spill control measures. However, there are many fields that have on- or off-field situations that require attention and can not be easily eliminated. For example, there may be no option as to placement of a pole or poles, which, in turn, might result in one or more fixtures on a pole creating on-field playability issues or unavoidable glare and spill problems with a particular house or off-field location.

Another example is the fact that the light used to illuminate a field ideally provides what is called playability for the players on the field. Many times, players cannot help but be in direct line-of-sight with some fixtures. This can affect the player's ability to play the game on the field (e.g. follow the flight of a ball). One approach in the past was to block light from any offending fixture. However, this would reduce the amount of available light for the field, which could either result in insufficient light for the field or require substantial added expense to add light to the field through other fixtures or methods. Many times, therefore, the issue is ignored or not addressed.

Another playability issue applies particularly to what can be called aerial sports (e.g. where a ball, as a part of the game, can move to locations well above the field). Since typical sports lighting systems have fixtures elevated on poles around the outside of the field, and the fixtures are typically aimed down towards the field, the volume of space above the center of the field (e.g. mid-field) may have substantially less light. This can make it difficult for a player to follow a ball in flight, especially if it moves from higher illumination areas to lower, or if the player loses continuous sight of the ball and must reacquire it.

Some of the glare and spill systems of Musco Corporation, e.g. TLC™ brand, can control glare and spill very well but mid-field playability may sometimes be affected somewhat. Other glare and spill control, e.g. Musco Corporation Level-8™ for example, can provide a good combination of glare and spill control with generally adequate mid-field playability. However, there can be situations where more mid-field playability illumination is desirable.

Therefore, the present invention relates to apparatus and methods for balancing the various and sometimes complicated issues of wide area lighting to try to optimize available light to and above the field at the most economic cost, but also includes specific remedies to improve playability to players or address glare and spill issues for indicated off-field sites.

III. BRIEF SUMMARY OF THE INVENTION

At a general level, one aspect of the present invention is to selectively use visors of relatively long length for selected fixtures for a lighting system. One option is selection of a relatively long visor for certain fixtures for specific playability or glare and spill issues for specific locations on or off the field. Another option is to use long visors on selected fixtures and shorter visors or no visors on other fixtures of the system. In doing so, selected playability and/or glare and/or spill issues are addressed and the remainder of the system can address other light level and uniformity issues for the field as well as other playability and/or glare and spill control issues, if any. Longer and shorter visors (or no visors) can therefore be mixed and matched according to indicated needs.

Another aspect of the present invention is a specific method of identifying which fixtures to modify with a long visor to improve playability for selected players on the field. A series of steps or rules are followed to determine generally which fixtures should be considered for the longer visors. For example, addition of a longer visor could shield direct view of the light source from a specific player or players in their normal on-field position(s). The method assists in identifying which fixtures may need a long visor, even at the design stage. Other fixtures could either have shorter visors or no visors depending on the other lighting needs of the field and its surrounding environment, which could include the desire to have larger mid-field playability illumination levels.

In another aspect of the invention, a similar type of analysis can be used to identify off-field glare and spill light problems and selectively address them by adding longer visors to selected fixtures (such as reducing or eliminating glare and spill to a single home across the street from the field which has direct line of sight to one or more fixtures). Shorter visors or no visors could be utilized on other fixtures depending on the other lighting needs of that field and its surrounding environment, including for the purpose to increase mid-field playability lighting for the field.

IV. BRIEF DESCRIPTION OF THE DRAWINGS

V. DETAILED DESCRIPTION OF EXEMPLARY EMBODIMENTS

The invention can perhaps best be understood in specific examples. Below are four such examples. Of course, the invention can take many different forms and embodiments and these examples do not limit the invention.

Each of the examples given below will reference the above-identified drawings.

Figure 1:
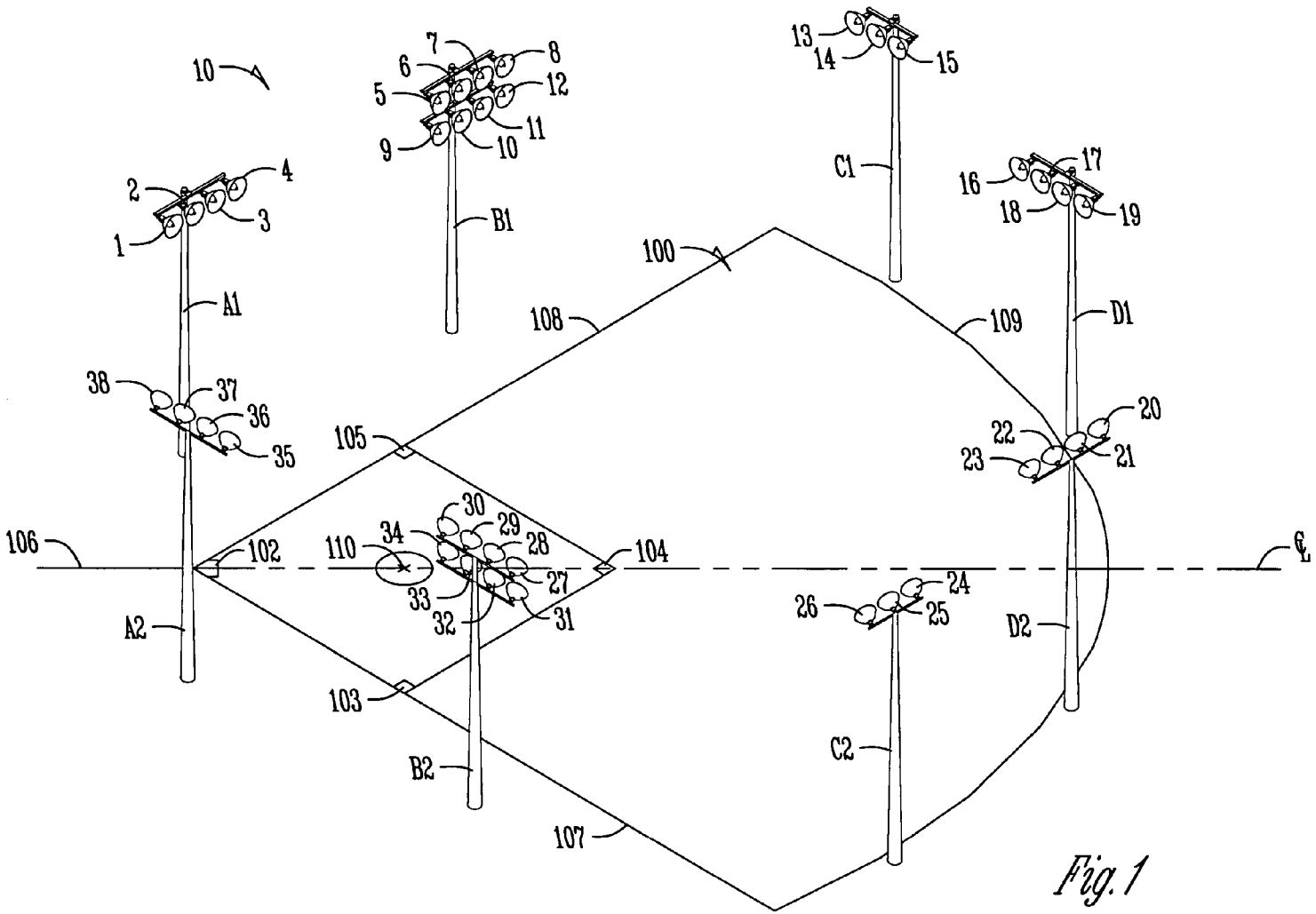
FIG. 1 is a diagrammatic view of a baseball field with a multi-fixture lighting system.

Each of the examples will also be discussed in the context of a lighting system such as is diagrammatically depicted in FIG. 1. FIG. 1 is a not-to-scale diagrammatic depiction of baseball field 100 (reference numerals 102, 103, 104, and 105 indicate home plate, first base, second base, and third base respectively). First base line 107, third base line 108, and outfield line or wall 109 define the perimeter limits of field 100. For purposes of this discussion, line 106 is basically a center line between home plate and outfield wall 109 through the pitcher's mound, dissecting the segment-shaped field 100. It also defines a line between home plate and the center of the pitcher's mound, thus approximating a line of sight between a batter and a pitcher. It can be important to eliminate or reduce any glare from a fixture in a batter's eyes when at bat for playability.

Figure 2:
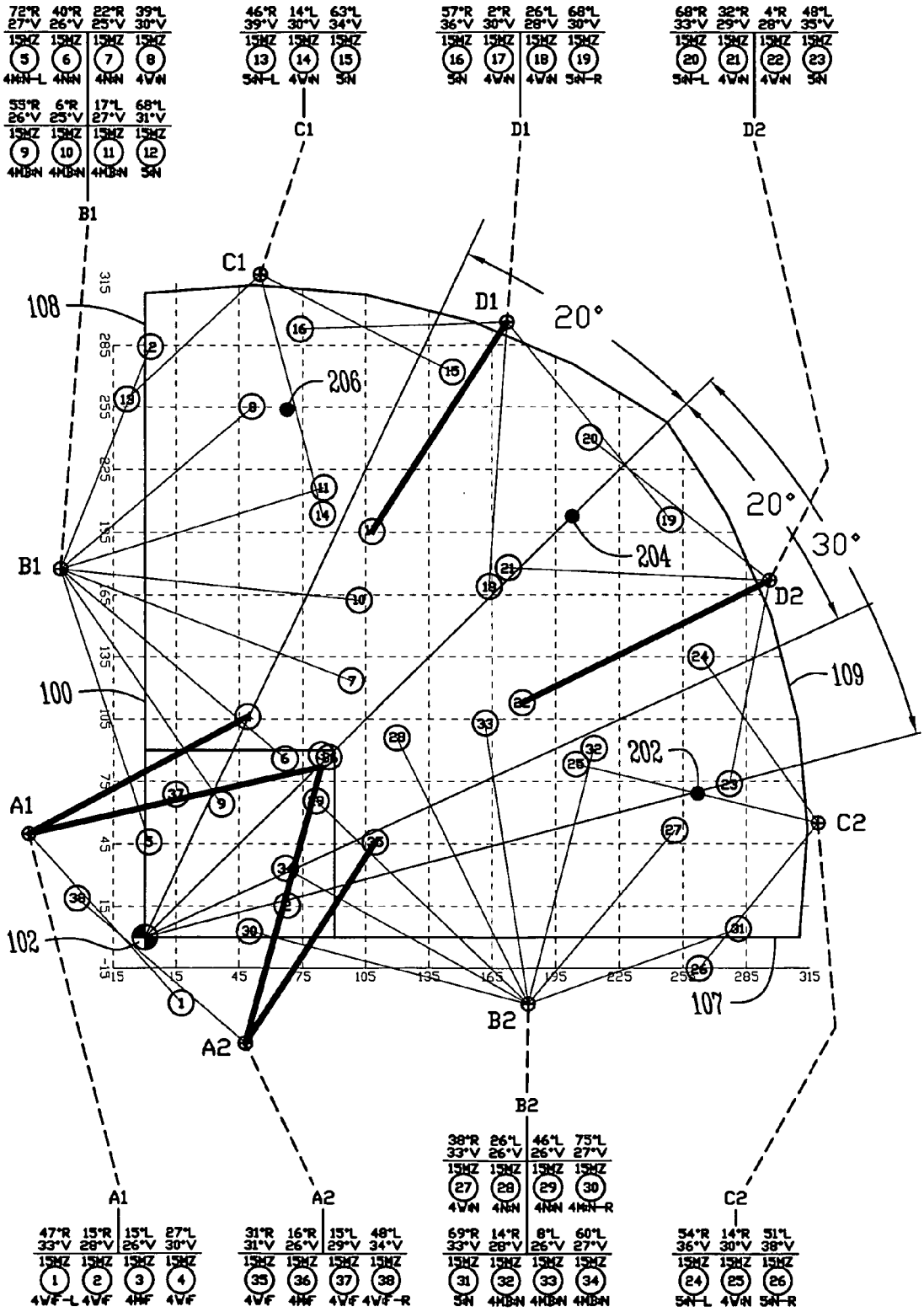
FIG. 2 is part of a lighting design plan view of the baseball field of FIG. 1 indicating aiming points for the lighting fixtures.

FIG. 2 shows an example of part of a lighting design and fixture aiming diagram chart by Musco Corporation for baseball field 100 of the dimensions indicated on FIG. 2. Typically, specifications regarding amount or intensity of light across the field, as well as uniformity of light across the field are specified. Utilizing computerized techniques known in the art, the design calls for thirty-eight fixtures (each with a 1500 watt HID lamp and numbered with reference numbers 1-38 in FIG. 1). They are elevated on eight poles (designated by A1, A2, B1, B2, C1, C2, D1, and D2 respectively) at positions spaced around field 100. As indicated at FIG. 2, mounting heights for the fixtures on cross arms near the top of the poles is approximately 70 feet above the ground.

The tables below provide additional details regarding the lighting system associated with the lighting aiming diagram of FIG. 2. Table 1 provides additional details, for this specific embodiment, regarding the height and size of the poles and the lighting fixture types. In this embodiment, lighting fixture types are available commercially from Musco Corporation.

TABLE 1

| Wind Speed: 90 MPH | | | Building Code: IBC |
|---|---|---|---|
| | LIGHTING EQUIPMENT | | |
| Approximate Footcandle Level: | 50/30 FC | Lamp Type | 1500 W MZ LSG 7 |
| Max to MIN Ratio Not to Exceed: | 2:1/2.5:1 | Finish | Galvanized |

| POLE | | | | LUMINAIRES | | | | ELECTRICAL LOAD | |
|---|---|---|---|---|---|---|---|---|---|
| | | | | | | Fixtures per pole | | Killowatt Consumption | |
| Pole Quantity | Pole Location | Mounting Height | Pole Size | Elev. | Fixture Type | /Unit | Total | /Unit | Total |
| 1 | A1 | 70' | 70A | 0 | LS-1500-4 | 4 | 4 | 6.24 | 6.24 |
| 1 | A2 | 70' | 70A | 0 | LS-1500-4 | 4 | 4 | 6.24 | 6.24 |
| 1 | B1 | 70' | 70B | 0 | LS-1500-8 | 8 | 8 | 12.48 | 12.48 |

TABLE 1-continued

| | | | | | | | | | |
|---|---|---|---|---|---|---|---|---|---|
| 1 | B2 | 70' | 70B | 0 | LS-1500-8 | 8 | 8 | 12.48 | 12.48 |
| 1 | C1 | 70' | 70A | 0 | LS-1500-3 | 3 | 3 | 4.68 | 4.68 |
| 1 | C2 | 70' | 70A | 0 | LS-1400-3 | 3 | 3 | 4.68 | 4.68 |
| 1 | D1 | 70' | 70A | 0 | LS-1500-4 | 4 | 4 | 6.24 | 6.24 |
| 1 | D2 | 70' | 70A | 0 | LS-1500-4 | 4 | 4 | 6.24 | 6.24 |
| 8 | | ← TOTALS → | | | | 38 | | 59.28 | |

Table 2 provides more detail regarding the specific location of the aiming points (the circled numbers 1-38 in FIG. 2). As shown in FIG. 2, home plate is indicated as the 0-0XY position in the two-dimensional plan view of the field. The numbers along the horizontal and vertical straight sides of the grid superposed on the field also have numbers indicating distance in feet. The field assumes 90-foot base paths and 310 feet to the right and left field corners, and 350 feet to straight on center field. Each of the squares indicated by dotted lines of the grid of FIG. 2 are 30 feet by 30 feet. Thus, for example, as shown in Table 2 below, aiming point 1 (the number 1 in a circle) is 18 feet from home base in a horizontal or X direction and minus 32 feet from home plate in a vertical direction.

TABLE 2

| | Aiming Points | | |
|---|---|---|---|
| Number | X | Y | Z |
| 1 | 18 | −32 | 0 |
| 4 | 49 | 106 | 0 |
| 5 | 2 | 46 | 0 |
| 8 | 51 | 255 | 0 |
| 13 | −9 | 259 | 0 |
| 15 | 146 | 272 | 0 |
| 16 | 73 | 293 | 0 |
| 19 | 248 | 201 | 0 |
| 20 | 211 | 240 | 0 |
| 23 | 277 | 74 | 0 |
| 24 | 263 | 135 | 0 |
| 26 | 262 | −16 | 0 |
| 27 | 251 | 52 | 0 |
| 30 | 50 | 3 | 0 |
| 35 | 108 | 46 | 0 |
| 38 | −32 | 19 | 0 |

Table 3 below indicates some additional features for this specific lighting system.

TABLE 3

| | | | | | | | | |
|---|---|---|---|---|---|---|---|---|
| BALLAST SPECIFICATIONS .90 Minimum Power Factor | VOLTAGE: 480 v | | | | | 3 PHASE | | |
| SINGLE PHASE VOLTAGE (also applicable to each single phase of a 3 phase system) | 120 | 208 | 240 | 277 | 347 | 380 | 415 | 480 |
| 1500 WATT METAL HALIDE LAMP Operating line amperage per fixture, max. draw | 15.0 | 8.6 | 7.5 | 6.5 | 5.1 | 4.7 | 4.2 | 3.7 |
| 1000 WATT METAL HALIDE LAMP Operating line amperage per fixture, max. draw | 9.5 | 5.4 | 4.8 | 4.1 | 3.3 | 3.0 | 2.7 | 2.4 |

To achieve the uniformity and intensity specifications, each of the fixtures 1-38 has a central aiming axis that is aimed to an aiming point indicated in FIG. 2 (see circled numbers 1-38 on or near field 100 each corresponding with a fixture 1-38 of the same number). Each of the aiming points indicates the intersection of the center of the beam with the surface of field 100. The center of the beam is usually the highest intensity. As is indicated in FIG. 2, some of the beams (see line between pole and aiming point on field 100 for each fixture) actually cross each other. However, it is generally true that fixtures on each pole are directed in angularly diverging directions from one another. The design tries to direct the beams from the eight pole locations in a pattern that achieves specified intensity and uniformity across the field.

A batter 200 would stand near home plate 102 and primarily look along line 106 to the pitcher when at bat. FIG. 2 also indicates typical normal positions for right fielder (reference number 202), center fielder (204), and left fielder (206) (each approximately 60 feet towards home plate from the outfield boundary or wall 109).

A. EXAMPLE 1

Improving Playability for Batter on Baseball Field

As can be appreciated, a batter standing at home plate 102 would be generally looking along center line 106 towards the pitcher. As indicated by FIG. 2, some of the fixtures have aiming directions generally towards home base 102 (e.g. fixtures 22 and 17). Because they are elevated on the order of 70 feet, even though most are angled down to aiming points on field 100 that are relatively far away from home plate 102, there is the potential a batter can see the light source in the fixture, or glare from reflection from light generated in the fixture.

As previously mentioned, one way to solve this is to change the aiming direction of such fixtures. Another way would be to block or blacken the offending part of any fixture. However, in either of those cases, it is likely that uniformity and intensity level to the field would be compromised and therefore undesirable or even unacceptable.

In this exemplary embodiment, the issue of a batter having glare from fixtures relative to field 100 is addressed as follows:

1. Step One

Figure 3:
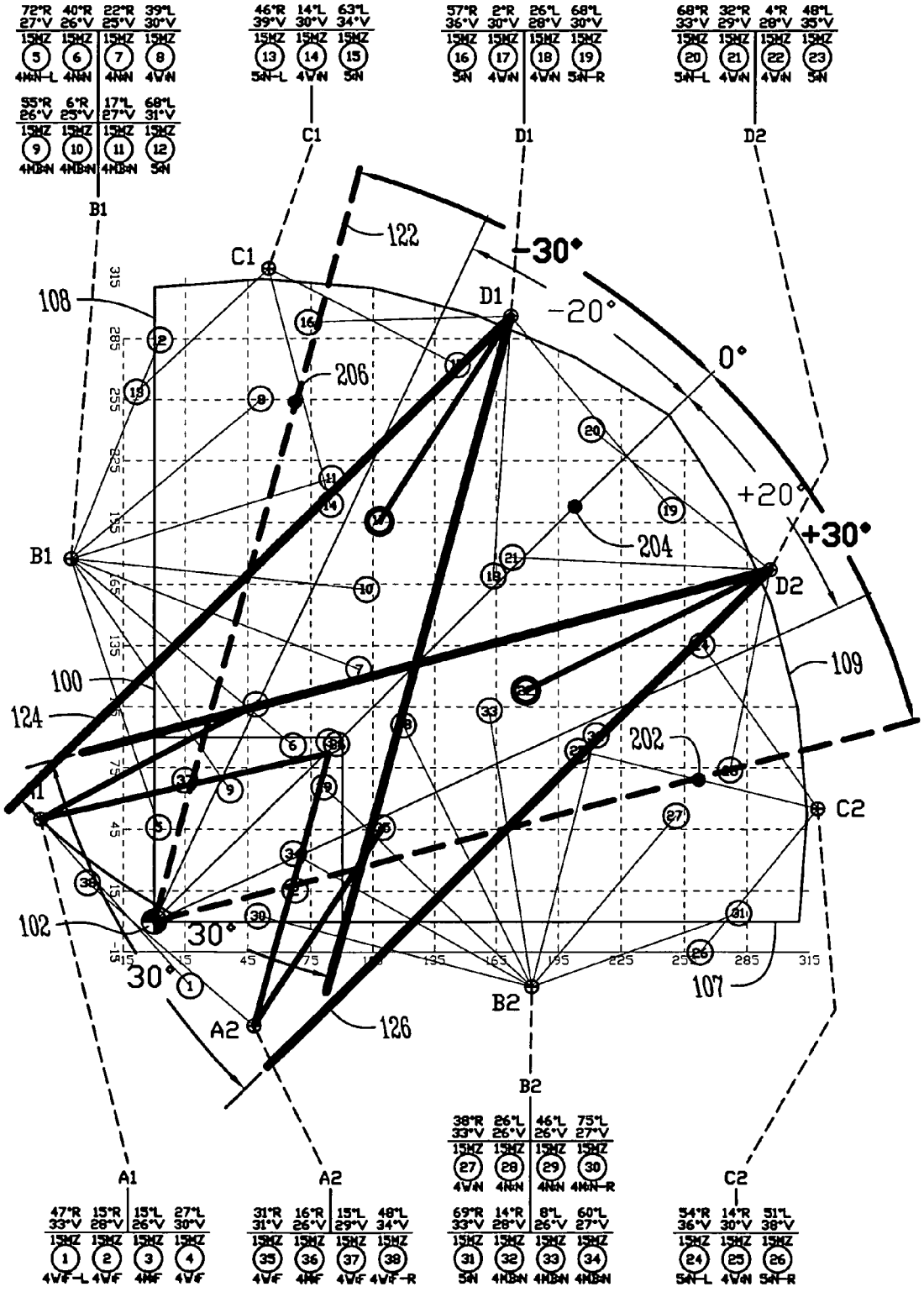
FIG. 3 is the same as FIG. 2 with the addition of superposed angular sectors used for a method according to the present invention to identify lighting fixtures requiring visors to improve playability for batters.

First, by referring to FIG. 3, an area defined by angle on either side of center line 106 is selected as an area of interest for considering adding long visors to fixtures on poles within that area to diminish possible glare to a batter. For a batter at home plate, one example of such an area (pie-shaped sector 122) is indicated in FIG. 3 by thick lines, namely plus or minus 30 degrees from center line 106 (with line 106 being 0 degrees). In this case two poles, D1 and D2, are implicated because they fall within sector 122. Thus, all the fixtures on D1 and D2 are then relevant for further evaluation for adding long visors.

The +/−30 degrees is considered a reasonable range of interest for either left or right handed batters relative to a pitcher. As indicated in FIG. 2, aiming directions of some fixtures on other poles are towards home plate and the batter, but not from a direction a batter generally looks at when batting.

2. Step Two

Once it is determined one or more poles are within the +/−30 degrees of line of sight of batter to pitcher, the next step helps determine if any fixture is likely to actually be a glare concern to batters. Because the aiming directions of fixtures on poles D1 and D2 vary significantly, only those fixtures reasonably aimed in the direction of the batter are considered for adding long visors. In this exemplary embodiment, any aiming point on field 100 within +/−15 degrees to line of sight from either pole D1 or D2 (30 degrees total arc) to the batter at home base 102 is considered eligible for a long visor. As shown in FIG. 3 by sectors 124 and 126, this implicates fixture 17 for pole D1 and fixture 22 for pole D2 (see circled numbers 17 and 22 within sectors 124 and 126 respectively). Aiming point 17 is the only aiming point of fixtures from pole D1 that is completely within a relevant sector (sector 124) of FIG. 3. Aiming point 22 is the only aiming point of fixtures from pole D2 that is completely within a relevant sector (sector 126) of FIG. 3. Again, the +/−30 degree segment 122 of FIG. 3 defines which poles are likely most relevant to a glare issue for the batter. Then, the +/−15 degree segment 124 or 126 from each relevant pole determines which fixtures on a pole are likely most relevant to a glare issue for the batter.

Thus, in this example, two fixtures of the thirty-eight total fixtures are implicated as eligible for long visors to reduce glare to a batter and/or improve playability for the batter.

3. Step Three

The last step is to confirm a long visor will materially improve playability. This step considers the distance and angle of the batter from the fixtures implicated by steps 1 and 2. Long visors will be applied to these fixtures 17 and 22 unless a batter at home base 102 is not far enough away from the fixtures. More specifically, if the batter is not a sufficient distance away, even a long visor may not effectively block direct sight of the light source and reduce any significant offending glare light from the fixture.

Figure 4B:
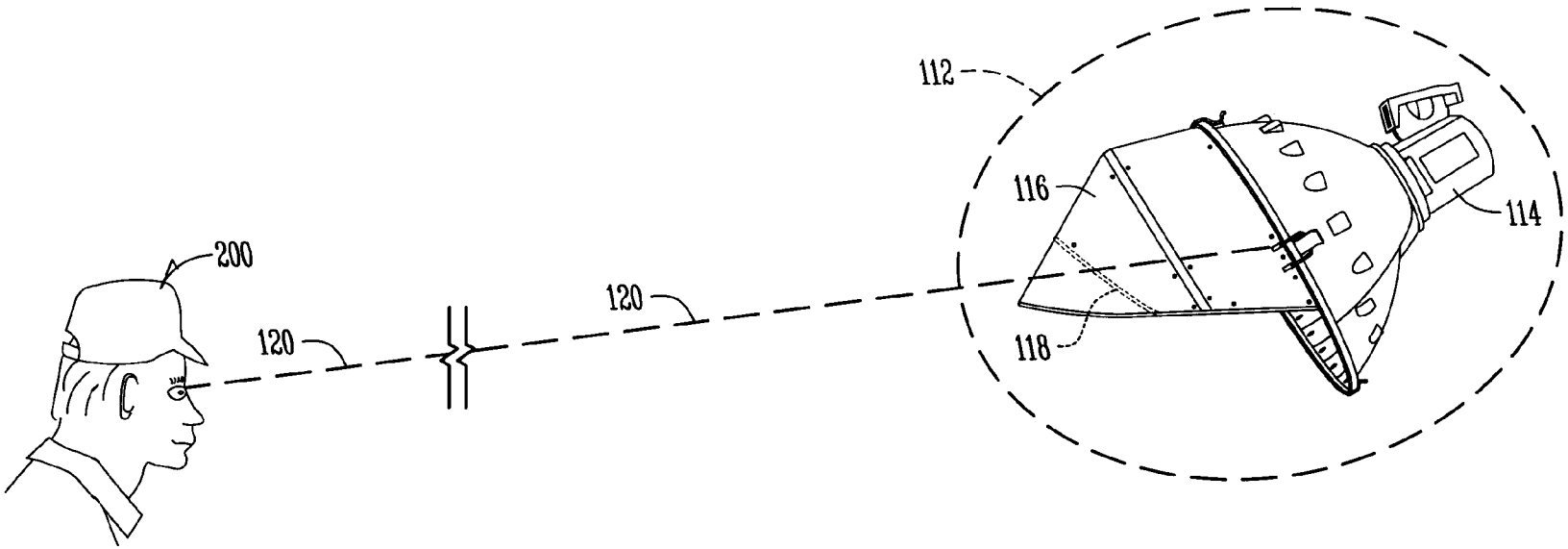
FIG. 4B is an additional diagram to illustrate the principle of FIG. 4A.
Figure 4A:
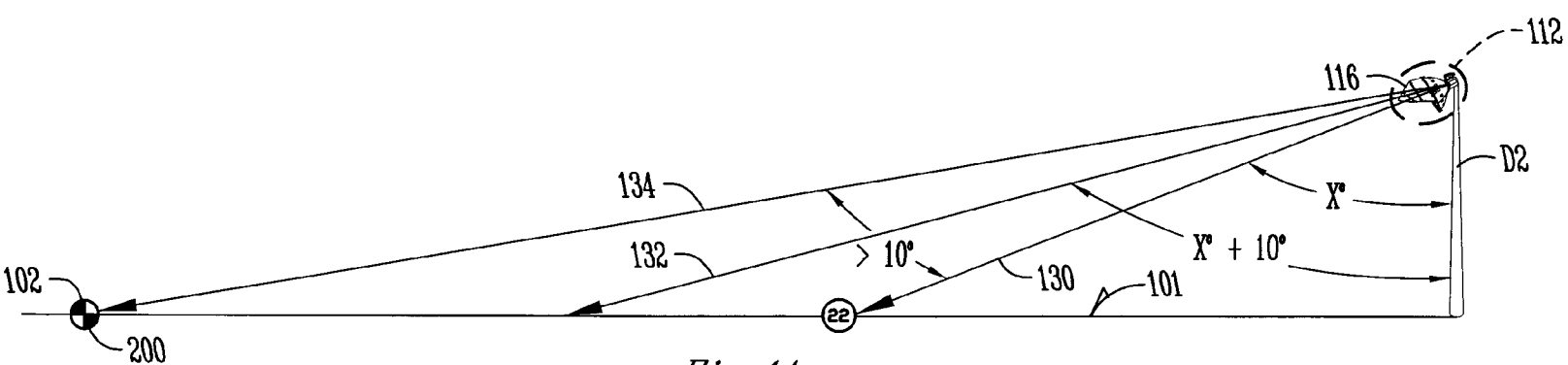
FIG. 4A is a side elevation diagram illustrating a step in the method for identifying which fixtures to which should be added visors to improve playability for a player.

This principle is illustrated in FIGS. 4A and B. In the case of the field of FIG. 3, a batter 200 at home plate 102 is over 300 feet from poles D1 and D2. Since the eligible fixtures 17 and 22 are elevated approximately 70 feet in the air, their angle with respect to the pole is indicated at FIG. 4A as X degrees. This acute angle X can be found by measuring the angle between the vertical pole and a line from the fixture to its aiming point (in FIG. 4A the example used is aiming location 22 on field 100). It has been determined that for the type of long visor contemplated in this exemplary embodiment, the player should be more than 10 degrees above that angle X. FIG. 4A shows in line 132 an angle 10 degrees greater than, or above, angle X (line 130). Based on geometry, for the field of FIG. 3, a batter at home plate 102 would be at an angle (see line 134) that is greater than or above line 132, which defines 10 degrees above angle X.

It has been determined that a long visor (hereinafter called long visor or 14 inch visor) on fixture 22 should be effective to reduce glare to a batter at home base 102 from fixture 22 because at an angle of over X plus 10 degrees, the long visor would block all or a significant amount of direct view of a batter of the light source of fixture 22, or the intense portion of the reflector for the fixture. This is illustrated diagrammatically at FIG. 4B as follows.

Fixtures 1-38 generally have a bowl-shaped reflector 112 with a HID light source 114 inside. Line 120 diagrammatically shows the direct line of sight from a batter 200 at home plate 102 relative to light source 114 and reflector 112 of fixture 22 in FIG. 3. Because of the geometrical relationship of the aiming angle of fixture 22 relative to field 100, a batter 200 likely would be able to directly view light source 114 in the interior of reflector 112 if no visor or other structure blocks such a view. This would cause glare in the batter's eyes and could affect performance of the batter. This is a playability issue for players on field 100—in particular batters at home plate 102. According to the method of this exemplary embodiment, fixture 22 could be modified by a long reflector 116 having a sufficient length to block direct sight of the light source 114 (along line 120) relative to most batters 200 at home plate 102. By doing so, glare would be reduced because direct sight of that high intensity light source would be blocked. This is in comparison to no visor on the fixture or even a short visor (the end of which is diagrammatically indicated by line 118 in FIG. 4B).

Therefore, in this exemplary embodiment, following rules 1-3 above, two fixtures, 17 and 22 would have long visors 116 added to increase playability for batters.

The specifics of long visor 116 can vary but can be derived by empirical methods. One example of a long visor 116 is shown in FIG. 4B (the longer, more hood-shaped 14-inch long version). Details about such a visor are set forth in co-owned, co-pending published application Publication No. 2006/018182 A1, and incorporated by reference herein. Note in particular how visor 116 is hood-shaped and extends out and down over the front of the fixture. FIG. 4B gives an indication of this—including an indication of how it could block at least direct view of the light source for certain aiming angles and could block direct view of almost the whole interior of the fixture, including at least a portion of the most intense part of the reflector surface, which could also cause glare. Compare this with a shorter visor (called 7 inch visor) indicated by dashed line 118 in FIG. 4B. The figures show the general proportion and size of long and short visors relative to a light fixture and HID lamp.

Therefore, by the simple addition of extended visors to two fixtures out of the thirty-eight, playability for batters can be increased.

The method step 1 first identifies what poles are suspect for batters. Step 2 then looks specifically at fixtures on those suspect poles that could likely create a glare issue for batters. Step 3 simply makes sure that adding a long visor would remedy or partially remedy the issue for batters. There are some circumstances where a player would be too close to the fixture that even a long visor would not remedy the situation (the batter could still see the light source—usually if at X+10 degrees or less per FIG. 4A).

B. EXAMPLE 2

Outfielders

In a similar fashion to Example 1, playability for outfielders can be improved following the general methodology described in Example 1. By additionally referring to FIGS. 5A-C, a second exemplary embodiment for outfielders can be described as follows.

1. Step One

A typical position for right fielder 202 (see FIG. 5A) is approximately 60 feet from fence 109 towards home plate 102. First, suspect poles are identified by looking approximately +/−20 degrees from the line of sight of the right fielder to the batter or home plate 102 (see sector 142 in FIG. 5A). The outfielder primarily concentrates on the batter. This implicates poles A1 and A2.

2. Step Two

Figure 5A:
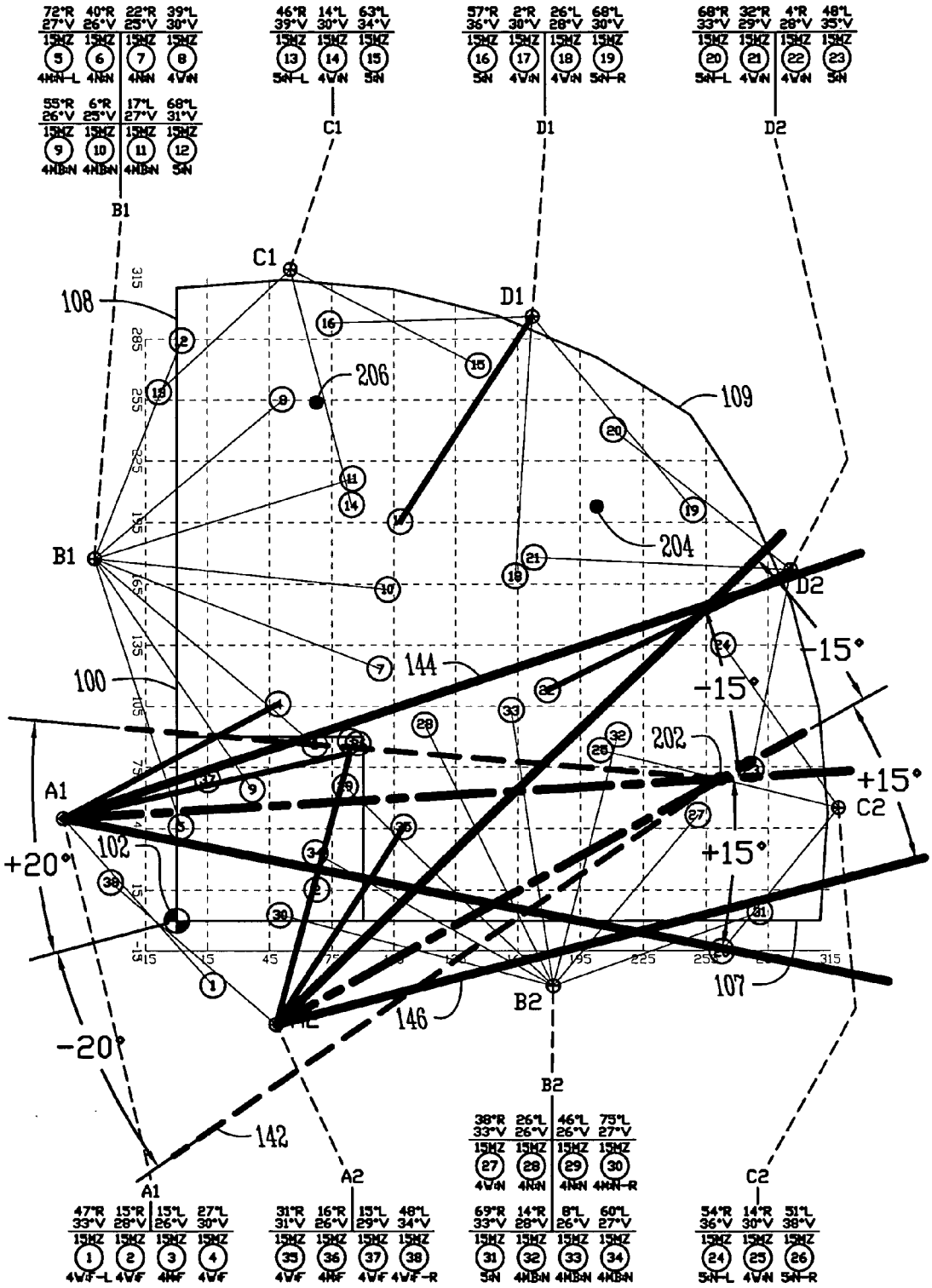
FIG. 5A is similar to FIG. 3 but with superposed angular sectors according to an exemplary embodiment of the present invention for identifying lighting fixtures requiring visors to improve playability for a right fielder.

Then, specific fixtures from poles A1 or A2 that might be a problem are identified by any aiming point of a fixture that falls on field 100 within +/−15 degrees of line of sight from either pole A1 or A2 to the right fielder location 202 (see sectors 144 and 146 respectively in FIG. 5A). As shown in FIG. 5A, none of the aiming points of fixtures of pole A2 fall squarely into sector 146. Therefore, no long visors on fixtures on pole A2 are indicated to be needed for the right fielder in this example. However, the aiming point for fixture 3 of pole A1 falls within the orange segment 144 in FIG. 5A. Thus, a long visor is indicated for fixture 3 relative to the right fielder.

3. Step Three

If a long visor was indicated for any fixture, a check would be made if the rule of FIG. 4A was satisfied, namely that outfielder 202 is more than 10 degrees above the angle between the pole and its relevant aiming point on field 100. In this example, this last step would be satisfied and a long visor would be added to fixture 3.

The same method can be used for center fielder 204 and left fielder 206. For center fielder 204, a +/−20 degrees segment from line of sight of the center fielder to the batter is identified (see sector 152 in FIG. 5B) to identify suspect poles (here A1 and A2 again). Then +/−15 degrees within line of sight from each pole back to the centerfielder (sectors 154 and 156) looks for aiming points from suspect relevant poles. In this case, fixtures 3 and 4 from pole A1 (circled aiming points 3 and 4 in FIG. 5B) and fixtures 35 and 36 from pole A2 (circled aiming points 35 and 36) fall within their relevant sector 154 or 156 of FIG. 5B. Long visors 70B would be placed on those four fixtures to reduce or eliminate glare for center fielder 204, if the test of FIG. 4A is met, which would be the case in this example.

Similarly, left fielder 206 would have a +/−20 degrees sector 162 (see sector 162 in FIG. 5C) that defines eligible poles. Aiming points within +/−15 degree sector 164 or 166 (see sectors 164 and 166 in FIG. 5C) would define which fixtures should be considered for long visors. In this case no fixtures for pole A1 qualify and only fixture 36 from pole A2 qualifies. A long visor 70B would be placed on fixture 36 if left fielder 206 meets the test of FIG. 4A, which would be the case in this example.

Thus, as can be seen by referring to FIGS. 5A, B, and C, for field 100, four fixtures would be modified by adding long 14-inch visors for improved playability for one or more of the three outfielders 202, 204, and 206.

Thus, it can be understood that for some lighting designs the method may not require any long visors, or only a few as in this example (four out of thirty-eight fixtures). Rarely would it require a lot of long visors.

C. EXAMPLE 3

As can be appreciated from Examples 1 and 2, a more comprehensive application of the method can be made for a whole baseball or softball field. The method can look for improved playability for a variety of players, not just batters, and not just outfielders.

Figure 5B:
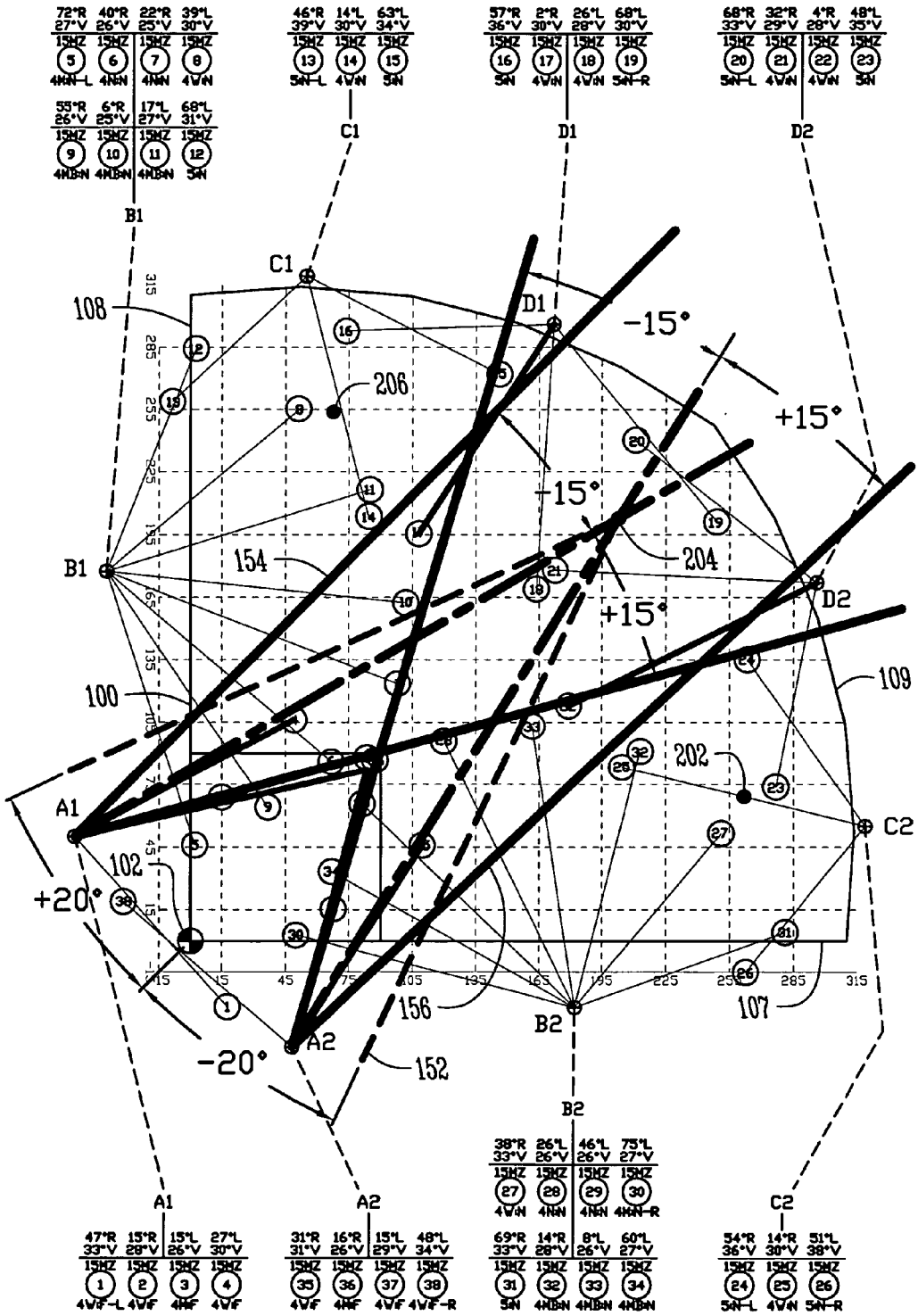
FIG. 5B is similar to FIG. 5A but with superposed angular sectors to improve playability for a center fielder.
Figure 5C:
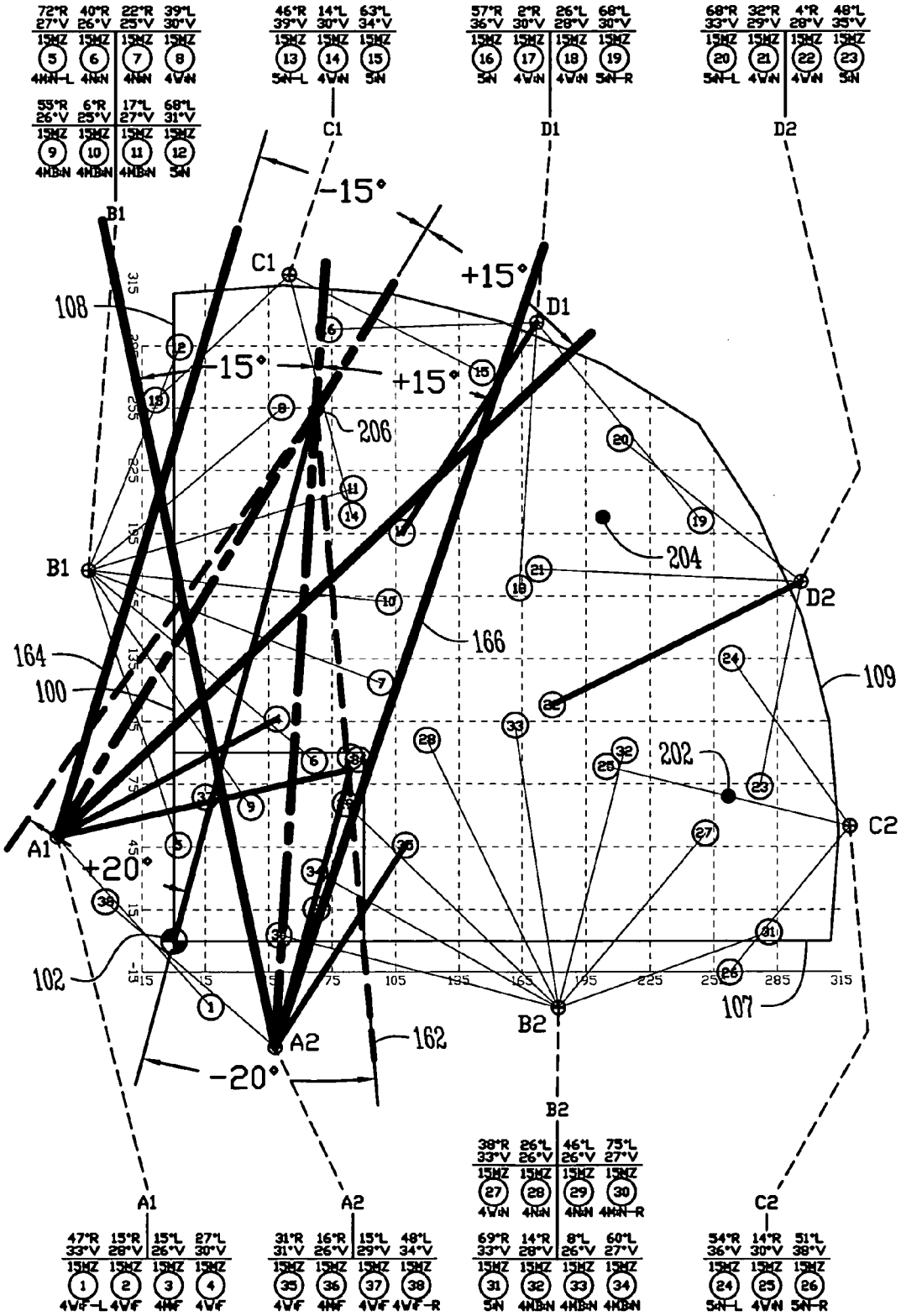
FIG. 5C is similar to FIGS. 5A and B but for improving playability for a left fielder.

For example, FIG. 3 indicates two long visors for poles D1 and D2 respectively would be added to fixtures 17 and 22 for playability of batters. FIGS. 5A-C indicate additional long visors for four other fixtures (numbers 3, 4, 35, 36). Therefore, as indicated by the thicker lines to aiming points 17, 22, 3, 4, 35 and 36 in FIG. 2, a total of six long visors could be utilized for field 100 using the steps outlined in Examples 1 and 2 above to improve playability for batters and outfielders.

The remaining fixtures out of the thirty-eight fixtures could have no more than shorter visors (7 inch visors). Some fixtures may have none. It may be best, according to design, that no visors be placed on some fixtures because there may not be off-field spill and glare issues for those fixtures, as will be discussed further below.

On the other hand, there could be situations where all the remaining fixtures have short visors. This would help with glare and spill light issues off the field, and will help create up light over the mid-field for playability. Of course, there could be selection of whether any visors or none go on selected fixtures depending on need or desire for the particular field.

D. EXAMPLE 4

Figure 6:
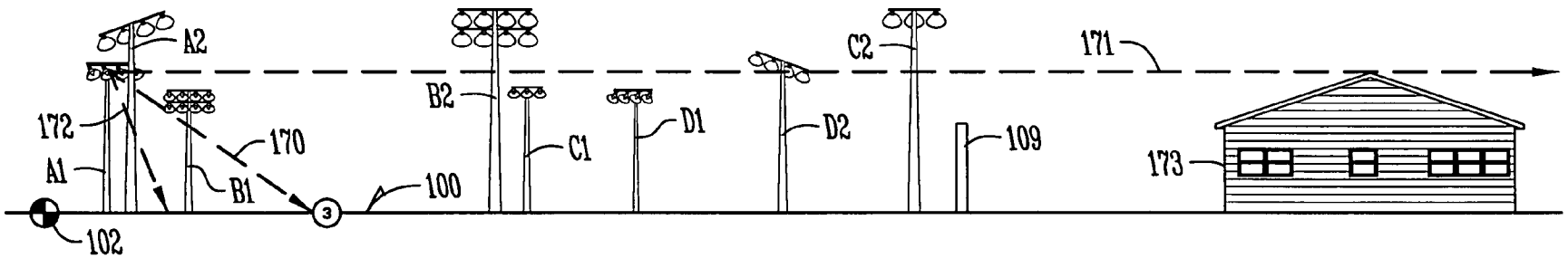
FIG. 6 is a side elevation diagram illustrating part of a methodology for identifying lighting fixtures requiring visors to provide glare and/or spill control for buildings outside the playing field, according to another aspect of the present invention.
Figure 7:
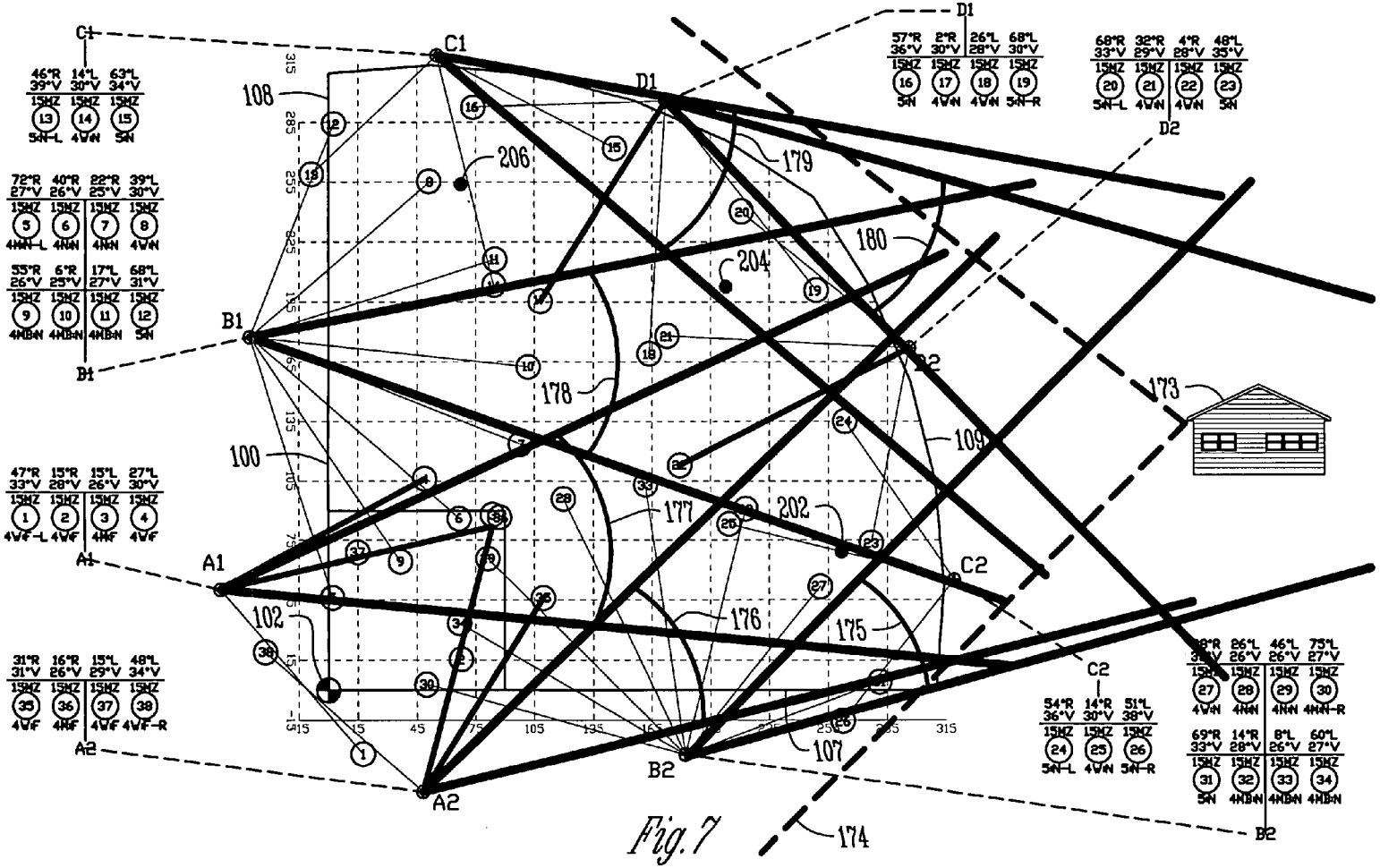
FIG. 7 is similar to FIG. 3 with superposed angular segments according to an aspect of the invention for identifying lighting fixtures requiring visors to improve glare and spill control for the house of FIG. 6 outside the playing field.

The types of considerations described for batters and outfielders in Examples 1 and 2 can also apply to addressing glare and spill light issues for off-field sites. For example, if a house 173 (see FIGS. 6 and 7) was relatively close to outfield wall 109, just across the street from pole D2, it also could have a glare or spill problem with certain fixtures of the lighting system. A similar regimen as described in Examples 1 and 2 could be adapted to address this.

For example, first an angular sector (see sector 174 in FIG. 7) from line of sight of the house to home plate could first be established to identify suspect poles. In this case the angle for sector 174 is wide enough to include all poles on field 100. All should normally be at least considered, as a house is relatively large (compared with just a single player) and usually has multiple normal viewing directions to the field.

Second, within sector 174, aiming points on field 100 falling within +/−15 degrees of line of sight from any pole back to house 173 (see sectors 175, 176, 177, 178, 179, and 180 from poles B2, A2, A1, B1, C1, and D1 respectively) could be identified (no angular sectors are drawn from poles D2 and C2 because all of their fixtures point substantially away from house 173). Long visors could be added to any fixture having an aiming point within any sector emanating from the pole of that fixture, so long as the test of FIG. 4A is met (the house is far enough away that a long visor could help). In this case, fixture 3 of pole A1, fixture 10 of pole B1, fixture 15 of pole C1 are implicated. Addition of long visors 70B to these fixtures could help reduce glare and spill to that off-site location.

E. OPTIONS AND ALTERNATIVES

It can therefore be seen that the method and apparatus utilized according to the exemplary embodiments can be directed towards improving playability for players on the field and/or improving glare and spill conditions for off-field sites. The above-described embodiments are by example only and not by way of limitation. Variations obvious to those skilled in the art will be included within the invention. Some examples of options or alternatives are set forth below.

The specific visors utilized (long or short) can vary in size and configuration depending on a number of factors. The examples in the drawings and references herein are illustrative only.

Visors used with the invention literally could be a range of lengths. The 14 and 7 inch lengths are examples selected for minimization of inventory and for balancing of a number of issues. There could be more length choices or even incremental variations in length to cover a variety of issues.

The circumstances upon which the longer version visor is applied can vary also. The exemplary embodiments give examples of one set of standards. The rules can vary according to need or desire. In other words, the initial angular sector of interest (the sectors 122, 142, 152, 162, and 174 in FIGS. 3, 5A-C, and 7) of the first step of the exemplary methods can be wider or narrower. The secondary smaller angular sectors 124, 126; 144, 146; 154, 156; 164, 166; and 175, 176, 177, 178, 179, 180 of the second step relative to aiming points on the field can be wider or narrower. Also, the angular test (≧10° above X° in FIG. 4A) for distance of the player (or off-site location) relative to the pole (the third step) of the light source under investigation can vary. The basic principles are laid out in the examples above.

By limiting the number of fixtures with long visors, more up-light is generally created for the mid-field. This can improve playability. For example, if a baseball is hit high in the air to the outfield, a certain amount of light above the field is needed for a player to be able to track the ball through its entire flight. There are times when a player turns his/her back on the ball and loses sight of it for a while and then must find it again. Short visors or no visors on the remaining fixtures can generally put enough up light in the air for that type of playability. If all fixtures had long visors, such playability may be lacking.

Another option and advantage of the invention is the selective ability to address certain on-field glare and spill or playability options. The examples speak only to batters and outfielders. There also might be reasons to address infielders, umpires, dugouts, and even spectators.

The invention can also be utilized in combination with other glare and spill control options or up lighting options.

The need for candle power above the field is many times important. Translucent inserts in longer visors could supply some of lighting while addressing glare and spill problems (see long visor 70B with translucent insert 77 shown and described in co-owned, co-pending published U.S. Application Publication No. 2006/0176704 A1, incorporated by reference herein. However, there are limitations on how much up light such translucent inserts 77 can provide. More candle power above the field than is possible with those translucent inserts may be required in certain circumstances. Other available glare control solutions may also not put sufficient candle power above the field for playability. The general methodology of the present invention allows for increased candle power above the field with the added advantage that selective playability and glare and spill issues can be addressed. For general reference, use of translucent inserts 77 could provide on the order of three thousand candle power above the field at the height of substantial baseball fly balls. The present methodology can supply on the order of 20-30 thousand candle power at least. This is believed to be more than sufficient for good playability such as tracking a baseball. Long visors can be applied only to selected fixtures (which tends to reduce up-light at mid-field). Short visors (or no visors) on the remainder tend to improve up-light at mid-field for playability.

Some of the considerations regarding this method may be affected by other factors. One would be the nature of the materials on field 100. For example, if the infield or entire field were made out of white crushed rock, reflection of light from it may supply enough up-lighting for playability. On the other hand, a dark green grass field could accentuate the need for more candle power above the field. Background (e.g. light or dark) can similarly affect up lighting. These things can be taken into account in designing the field.

What is claimed is:

1. A method of lighting a sports field with a sports lighting system including a plurality of lighting fixtures elevated on a plurality of poles, each fixture having a pre-determined aiming point on the field, comprising:

a. identifying a point of view on or near the field at or from which increased playability and/or decreased glare or spill light is desired;

b. identifying one or more poles having fixtures that may affect playability or glare and spill from the point of view by identifying poles having fixtures that are generally within a sector emanating from the point of view;

c. identifying one or more fixtures of each of said one or more poles that may affect playability or glare and spill for the point of view by identifying aiming points that fall within a sector centered on a line between each said one or more poles identified in step b and the point of view;

d. including a component to a fixture identified in step c which shields or diminishes light and/or direct view of light from the fixture from the point of view;

so that one or more said fixtures with said component will increase playability and/or decrease glare or spill light relative to the point of view.

2. The method of claim 1 wherein the point of view is a player location relative to another point on the field.

3. The method of claim 1 wherein the point of view is a location off the field relative to a point on or around the field.

4. The method of claim 3 wherein the location off the field comprises a dwelling.

5. The method of claim 1 wherein playability comprises ability of a player on the field to see people or objects.

6. The method of claim 1 wherein glare or spill control comprises controlling or reducing perceived glare or actual light levels.

7. The method of claim 1 wherein the sports field comprises a field on which aerial sports are played.

8. The method of claim 7 wherein the aerial sport is baseball.

9. The method of claim 1 wherein the component is a visor.

10. The method of claim 1 further comprising:

adding the component only to a fixture identified in step c that is a sufficient distance away from the point of view that a light source in the fixture would be at least partially obscured from the point of view.

11. A method of designing a sports lighting system including a plurality of lighting fixtures elevated on a plurality of poles comprising:

a. computing a pre-determined aiming point for each fixture on a design plan of the field;

b. identifying a point of view on the design plan of the field at or from which increased playability and/or decreased glare or spill light is desired;

c. identifying one or more poles having fixtures that may affect playability or glare and spill from the point of view by identifying poles having fixtures that are generally within a sector emanating from the point of view;

d. identifying one or more fixtures of each of said one or more poles that may affect playability or glare and spill for the point of view by identifying aiming points that fall within a sector centered on a line between each said one or more poles identified in step c and the point of view;

e. including a component to a fixture identified in step d which shields or diminishes light and/or direct view of light from the fixture from the point of view;

f. so that one or more said fixtures with said component will increase playability and/or decrease glare or spill light relative to the point of view.

12. The method of claim 11 further comprising adding the component only to a fixture identified in step d that is a sufficient distance away from the point of view that a light source in the fixture would be at least partially obscured from the point of view.

13. The method of claim 11 wherein the design plan is accomplished on a computer.

14. The method of claim 13 wherein the design plan is applied to an actual lighting system.

15. A method of designing the addition of long visors to selected fixtures of a baseball sports lighting system for improving playability and/or glare or spill light control comprising:

a. identifying if any poles fit within a range of degrees of a line between a home plate and a pitchers mound;

b. if so, identifying if any aiming points to the field for any fixtures on such a pole fall within a second range of degrees of a line between the pole and home plate;

c. if so, adding a long visor to the fixture if home plate is greater than a third range of degrees above a line between the fixture and the aiming point;

d. for each of designated right, center, and left fielder positions on the field, identifying if any poles fit within a fourth range of degrees of a line between each such position and home plate;

e. if so, identifying if any aiming points to the field for any fixtures on such a pole fall within a fifth range of degrees of a line between the pole and such position;

f. if so, adding a relatively large visor to the fixture if such position is greater than a sixth range of degrees above a line between the fixture and the aiming point.

16. The method of claim 15 further comprising adding short visors to at least some of the remaining fixtures of the lighting system.

17. The method of claim 15 wherein the first and fourth range of degrees is approximately +/−30 degrees; the second and fifth range of degrees is approximately +/−15 degrees, and the third and sixth range of degrees is approximately 10 degrees.

18. A method of lighting a sports field with a sports lighting system including a plurality of lighting fixtures elevated on at least one elevating structure, each light fixture having an aiming point on the field, comprising:

a. identifying a point of view on or near the field at or from which increased playability and/or decreased glare or spill light is desired;

b. identifying one or more elevating structures having fixtures that may affect playability or glare and spill from the point of view by identifying elevating structures having fixtures that are generally within a sector emanating from the point of view;

c. identifying one or more fixtures of each of said one or more elevating structures that may affect playability or glare and spill for the point of view by identifying aiming points that fall within a sector centered on a line between each said one or more elevating structures identified in step b and the point of view;

d. including a component to a fixture identified in step c which shields or diminishes light and/or direct view of light from the fixture from the point of view;

so that one or more said fixtures with said component will increase playability and/or decrease glare or spill light relative to the point of view.

19. The method of claim 18 wherein the point of view is a player location relative to another point on the field.

20. The method of claim 18 wherein the point of view is a location off the field relative to a point on or around the field.

21. The method of claim 20 wherein the location off the field comprises a dwelling.

22. The method of claim 18 wherein playability comprises ability of a player on the field to see people or objects.

23. The method of claim 18 wherein glare or spill control comprises controlling or reducing perceived glare or actual light levels.

24. The method of claim 18 wherein the sports field comprises a field on which aerial sports are played.

25. The method of claim 24 wherein the aerial sport is baseball.

26. The method of claim 18 wherein the component is a visor.

27. The method of claim 18 further comprising:

adding the component only to a fixture identified in step c that is a sufficient distance away from the point of view that a light source in the fixture would be at least partially obscured from the point of view.

28. A method of designing a sports lighting system including a plurality of lighting fixtures elevated on at least one elevating structure comprising:

a. computing a pre-determined aiming point for each fixture on a design plan of a field;

b. identifying a point of view on the design plan of the field at or from which increased playability and/or decreased glare or spill light is desired;

c. identifying one or more elevating structures having fixtures that may affect playability or glare and spill from the point of view by identifying elevating structures having fixtures that are generally within a sector emanating from the point of view;

d. identifying one or more fixtures of each of said one or more elevating structures that may affect playability or glare and spill for the point of view by identifying aiming points that fall within a sector centered on a line between each said one or more elevating structures identified in step c and the point of view;

e. including a component to a fixture identified in step d which shields or diminishes light and/or direct view of light from the fixture from the point of view;

f. so that one or more said fixtures with said component will increase playability and/or decrease glare or spill light relative to the point of view.

29. The method of claim 28 further comprising adding the component only to a fixture identified in step d that is a sufficient distance away from the point of view that a light source in the fixture would be at least partially obscured from the point of view.

30. The method of claim 28 wherein the design plan is accomplished on a computer.

31. The method of claim 30 wherein the design plan is applied to an actual lighting system.

32. A method of designing the addition of a visor to selected lighting fixtures of an aerial sports lighting system for improving playability and/or glare or spill light control comprising:

a. identifying if any fixtures fit within a range of degrees of a line between a home plate and a pitchers mound;

b. if so, identifying if any aiming points to the field for any fixtures fall within a second range of degrees of a line between the fixture and home plate;

c. if so, adding a long visor to the fixture if home plate is greater than a third range of degrees above a line between the fixture and the aiming point;

d. for each of designated right, center, and left fielder positions on the field, identifying if any fixtures fit within a fourth range of degrees of a line between each such position and home plate;

e. if so, identifying if any aiming points to the field for any fixtures fall within a fifth range of degrees of a line between the fixture and such position;

f. if so, adding a relatively large visor to the fixture if such position is greater than a sixth range of degrees above a line between the fixture and the aiming point.

33. The method of claim 32 further comprising adding short visors to at least some of the remaining fixtures of the lighting system.

34. The method of claim 32 wherein the first and fourth range of degrees is approximately +/−30 degrees; the second and fifth range of degrees is approximately +/−15 degrees, and the third and sixth range of degrees is approximately 10 degrees.

35. A method of lighting a large area with a lighting system including a plurality of lighting fixtures elevated on a plurality of elevating structures, each light fixture having a predetermined aiming point on the area, comprising:

a. identifying a point of view on or near the area at or from which increased playability and/or decreased glare or spill light is desired;

b. identifying one or more elevating structures having fixtures that may affect playability or glare and spill from the point of view by identifying elevating structures having fixtures that are generally within a sector emanating from the point of view;

c. identifying one or more fixtures of each of said one or more elevating structures that may affect playability or glare and spill for the point of view by identifying aiming points that fall within a sector centered on a line between each said one or more elevating structures identified in step b and the point of view;

d. including a component to a fixture identified in step c which shields or diminishes light and/or direct view of light from the fixture from the point of view;

so that one or more said fixtures with said component will increase playability and/or decrease glare or spill light relative to the point of view.

36. The method of claim 35 wherein the point of view is a viewer location relative to another point on the area.

37. The method of claim 35 wherein the point of view is a location off the area relative to a point on or around the area.

38. The method of claim 37 wherein the location off the area comprises a dwelling.

39. The method of claim 35 wherein playability comprises ability of a viewer on the area to see people or objects.

40. The method of claim 35 wherein glare or spill control comprises controlling or reducing perceived glare or actual light levels.

41. The method of claim 35 wherein the area comprises a field on which aerial sports are played.

42. The method of claim 41 wherein the aerial sport is baseball.

43. The method of claim 35 wherein the component is a visor.

44. The method of claim 35 further comprising:

adding the component only to a fixture identified in step c that is a sufficient distance away from the point of view that a light source in the fixture would be at least partially obscured from the point of view.

45. A method of designing a lighting system including a plurality of lighting fixtures elevated on a plurality of elevating structures comprising:

a. computing a pre-determined aiming point for each fixture on a design plan of an area;

b. identifying a point of view on the design plan of the area at or from which decreased glare or spill light is desired;

c. identifying one or more elevating structures having fixtures that may affect glare and spill from the point of view by identifying elevating structures having fixtures that are generally within a sector emanating from the point of view;

d. identifying one or more fixtures of each of said one or more elevating structures that may affect glare and spill for the point of view by identifying aiming points that fall within a sector centered on a line between each said one or more elevating structures identified in step c and the point of view;

e. including a component to a fixture identified in step d which shields or diminishes light and/or direct view of light from the fixture from the point of view;

f. so that one or more said fixtures with said component will decrease glare or spill light relative to the point of view.

46. The method of claim 45 further comprising adding the component only to a fixture identified in step d that is a sufficient distance away from the point of view that a light source in the fixture would be at least partially obscured from the point of view.

47. The method of claim 45 wherein the design plan is accomplished on a computer.

48. The method of claim 47 wherein the design plan is applied to an actual lighting system.

49. A method of designing the addition of long visors to selected lighting fixtures of a lighting system for improving glare or spill light control to an area comprising:

a. identifying if any fixtures fit within a range of degrees of a line between a first point on the area and a second point on the area;

b. if so, identifying if any aiming points to the field for any fixtures fall within a second range of degrees of a line between the fixture and the first point;

c. if so, adding a long visor to the fixture if the first point is greater than a third range of degrees above a line between the fixture and the aiming point;

d. for each of plural designated positions on the area, identifying if any fixtures fit within a fourth range of degrees of a line between each such position and the first point;

e. if so, identifying if any aiming points to the area for any fixtures fall within a fifth range of degrees of a line between the fixture and such position;

f. if so, adding a relatively large visor to the fixture if such position is greater than a sixth range of degrees above a line between the fixture and the aiming point.

50. The method of claim 49 further comprising adding short visors to at least some of the remaining fixtures of the lighting system.

51. The method of claim 49 wherein the first and fourth range of degrees is approximately +/−30 degrees; the second and fifth range of degrees is approximately +/−15 degrees, and the third and sixth range of degrees is approximately 10 degrees.

* * * * *